US009410276B2

(12) United States Patent
Hall et al.

(10) Patent No.: US 9,410,276 B2
(45) Date of Patent: Aug. 9, 2016

(54) YARN COLOR PLACEMENT SYSTEM

(71) Applicant: Card-Monroe Corp., Chattanooga, TN (US)

(72) Inventors: Wilton Hall, Ringgold, GA (US); Kendall Johnston, Dalton, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 14/321,152

(22) Filed: Jul. 1, 2014

(65) Prior Publication Data

US 2014/0311392 A1 Oct. 23, 2014

Related U.S. Application Data

(63) Continuation of application No. 13/422,238, filed on Mar. 16, 2012, now Pat. No. 8,776,703, which is a continuation of application No. 12/122,004, filed on May 16, 2008, now Pat. No. 8,141,505.

(60) Provisional application No. 61/029,105, filed on Feb. 15, 2008.

(51) Int. Cl.
*D05C 15/30* (2006.01)
*D05C 15/36* (2006.01)
(Continued)

(52) U.S. Cl.
CPC ..... *D05C 15/36* (2013.01); *D05C 15/26* (2013.01); *D05C 15/30* (2013.01); *D05C 15/32* (2013.01); *D05C 15/34* (2013.01)

(58) Field of Classification Search
CPC ..... D05C 15/26; D05C 15/28; D05C 15/30; D05C 15/32; D05C 15/34; D05C 15/36
USPC ..... 112/80.01, 80.23, 80.3–80.32, 80.4, 112/80.41, 470.01
See application file for complete search history.

(56) References Cited

U.S. PATENT DOCUMENTS 2,811,244 A 10/1957 MacCaffray, Jr.
2,818,037 A 12/1957 McNutt
(Continued)

FOREIGN PATENT DOCUMENTS

EP 1474354 B1 7/2010
EP 2 100 994 B1 6/2011
(Continued)

OTHER PUBLICATIONS

Decision Denying Institution of Inter Partes Review entered Jul. 22, 2015.
(Continued)

*Primary Examiner* — Nathan Durham
(74) *Attorney, Agent, or Firm* — Womble Carlyle Sandridge & Rice, LLP

(57) ABSTRACT

A yarn color placement system for a tufting machine including a series of different color yarns being fed to the needles of the tufting machine by yarn feed mechanisms. A backing material is fed through the tufting machine at an increased stitch rate as the needles are shifted according to the programmed pattern steps. A series of level cut loop loopers or hooks engage and pick loops of yarns from the needles, with the clips of the level cut loop loopers or hooks being selectively actuated to form cut pile tufts, while the remaining loops of yarns can be back-robbed so as to be hidden from view in the finished patterned tufted article.

23 Claims, 8 Drawing Sheets

(51) Int. Cl.

| | |
|---|---|
| ***D05C 15/26*** | (2006.01) |
| ***D05C 15/32*** | (2006.01) |
| ***D05C 15/34*** | (2006.01) |

(56) References Cited

U.S. PATENT DOCUMENTS

| | | | |
|---|---|---|---|
| 2,840,019 | A | 6/1958 | Beasley |
| 2,842,259 | A | 7/1958 | Hoeselbarth |
| 2,866,424 | A | 12/1958 | Masland, II |
| 2,883,735 | A | 4/1959 | Hoeselbarth |
| 2,932,181 | A | 4/1960 | MacCaffray, Jr. |
| 2,965,054 | A | 12/1960 | Masland, II |
| 2,983,028 | A | 5/1961 | Cole |
| 2,990,792 | A | 7/1961 | Nowicki et al. |
| 2,991,738 | A | 7/1961 | Zenner et al. |
| 2,968,856 | A | 12/1961 | Allen |
| 3,016,029 | A | 1/1962 | Card |
| 3,026,029 | A | 1/1962 | Card |
| 3,026,830 | A | 3/1962 | Bryant et al. |
| 3,056,364 | A | 10/1962 | Dedmon |
| 3,067,701 | A | 12/1962 | Wilcox |
| 3,084,644 | A | 4/1963 | Card |
| 3,084,645 | A | 4/1963 | Card |
| 3,091,199 | A | 5/1963 | Ballard |
| 3,095,840 | A | 7/1963 | Ballard |
| 3,095,841 | A | 7/1963 | Ballard |
| 3,103,903 | A | 9/1963 | Broadrick et al. |
| 3,109,395 | A | 11/1963 | Batty et al. |
| 3,160,125 | A | 12/1964 | Bryant et al. |
| 3,162,155 | A | 12/1964 | Charles |
| 3,177,833 | A | 4/1965 | Passons |
| 3,202,379 | A | 8/1965 | Dedmon et al. |
| 3,203,388 | A | 8/1965 | Parlin et al. |
| 3,220,371 | A | 11/1965 | Short et al. |
| 3,259,088 | A | 7/1966 | Rockholt |
| 3,272,163 | A | 9/1966 | Erwin, Jr. et al. |
| 3,332,379 | A | 7/1967 | Cobble, Sr. et al. |
| 3,361,096 | A | 1/1968 | Watkins |
| 3,375,797 | A | 4/1968 | Gaines |
| 3,393,654 | A | 7/1968 | Barnes |
| 3,396,687 | A | 8/1968 | Nowicki |
| 3,433,188 | A | 3/1969 | Pickles |
| 3,435,787 | A | 4/1969 | Short |
| 3,485,195 | A | 12/1969 | Torrence |
| 3,490,399 | A | 1/1970 | Hesz |
| 3,547,058 | A | 12/1970 | Brown et al. |
| 3,554,147 | A | 1/1971 | Spanel |
| 3,577,943 | A | 5/1971 | Watkins |
| 3,585,948 | A | 6/1971 | Cobble |
| 3,605,660 | A | 9/1971 | Short |
| 3,618,542 | A | 11/1971 | Zocher |
| 3,623,440 | A | 11/1971 | Spedding et al. |
| 3,662,697 | A | 5/1972 | Passons et al. |
| 3,670,672 | A | 6/1972 | Spanel |
| 3,688,804 | A | 9/1972 | Brown et al. |
| 3,701,464 | A | 10/1972 | Crum |
| 3,709,173 | A | 1/1973 | Greene |
| 3,752,094 | A | 8/1973 | Short |
| 3,752,095 | A | 8/1973 | Brown et al. |
| 3,757,709 | A | 9/1973 | Cobble |
| 3,812,799 | A | 5/1974 | Spanel et al. |
| 3,824,939 | A | 7/1974 | Spanel et al. |
| 3,835,797 | A | 9/1974 | Franks et al. |
| 3,842,767 | A | 10/1974 | Short |
| 3,847,098 | A | 11/1974 | Hammel, Jr. |
| 3,865,059 | A | 2/1975 | Jackson |
| 3,875,883 | A | 4/1975 | Eberwein et al. |
| 3,881,432 | A | 5/1975 | Dodd et al. |
| 3,908,881 | A | 9/1975 | McCann |
| 3,919,953 | A | 11/1975 | Card et al. |
| 3,934,524 | A | 1/1976 | Smith |
| 3,937,156 | A | 2/1976 | Spanel |
| 3,937,157 | A | 2/1976 | Spanel et al. |
| 3,937,158 | A | 2/1976 | Spanel |
| 3,937,159 | A | 2/1976 | Spanel |
| 3,937,160 | A | 2/1976 | Spanel |
| 3,943,865 | A | 3/1976 | Short et al. |
| 3,972,295 | A | 8/1976 | Smith |
| 3,978,800 | A | 9/1976 | Card et al. |
| 3,982,491 | A | 9/1976 | Herzer et al. |
| 4,015,550 | A | 4/1977 | Bartenfeld et al. |
| 4,029,030 | A | 6/1977 | Smith |
| 4,047,491 | A | 9/1977 | Spanel et al. |
| 4,048,930 | A | 9/1977 | Card |
| 4,064,816 | A | 12/1977 | Spanel et al. |
| 4,089,281 | A | 5/1978 | Landoni |
| 4,100,863 | A | 7/1978 | Shortte, Jr. |
| 4,103,629 | A | 8/1978 | Card |
| 4,106,416 | A | 8/1978 | Blackstone, Jr. et al. |
| 4,119,047 | A | 10/1978 | Spanel et al. |
| 4,127,078 | A | 11/1978 | Spanel et al. |
| 4,134,347 | A | 1/1979 | Jolley et al. |
| 4,134,348 | A | 1/1979 | Scott |
| 4,138,956 | A | 2/1979 | Parsons |
| 4,154,176 | A | 5/1979 | Spanel et al. |
| 4,155,319 | A | 5/1979 | Short |
| 4,170,949 | A | 10/1979 | Lund |
| 4,173,192 | A | 11/1979 | Schmidt et al. |
| 4,185,569 | A | 1/1980 | Inman |
| 4,193,358 | A | 3/1980 | Woodcock |
| 4,195,580 | A | 4/1980 | Hurst |
| 4,221,317 | A | 9/1980 | Fukada et al. |
| 4,224,884 | A | 9/1980 | Shortte et al. |
| 4,241,675 | A | 12/1980 | Bardsley |
| 4,241,676 | A | 12/1980 | Parsons et al. |
| 4,244,309 | A | 1/1981 | Spanel et al. |
| 4,244,884 | A | 1/1981 | Spanel et al. |
| 4,245,794 | A | 1/1981 | Hasegawa et al. |
| 4,254,718 | A | 3/1981 | Spanel et al. |
| 4,255,050 | A | 3/1981 | Beckstein et al. |
| 4,261,498 | A | 4/1981 | Short |
| 4,267,787 | A | 5/1981 | Fukuda |
| 4,303,024 | A | 12/1981 | Bardsley |
| 4,303,189 | A | 12/1981 | Wiley et al. |
| 4,313,388 | A | 2/1982 | Biggs et al. |
| 4,317,419 | A | 3/1982 | Spanel et al. |
| 4,320,711 | A | 3/1982 | Slattery et al. |
| 4,353,317 | A | 10/1982 | Crumbliss |
| 4,365,565 | A | 12/1982 | Kawai et al. |
| 4,366,761 | A | 1/1983 | Card |
| 4,369,720 | A | 1/1983 | Beasley |
| 4,370,937 | A | 2/1983 | Denny |
| 4,384,538 | A | 5/1983 | Slattery |
| 4,393,793 | A | 7/1983 | Beasley |
| 4,397,249 | A | 8/1983 | Slattery |
| 4,399,758 | A | 8/1983 | Bagnall |
| 4,401,024 | A | 8/1983 | Frentress |
| 4,419,944 | A | 12/1983 | Passons et al. |
| 4,429,648 | A | 2/1984 | Slattery |
| 4,440,102 | A | 4/1984 | Card et al. |
| 4,445,447 | A | 5/1984 | Bardsley et al. |
| 4,448,137 | A | 5/1984 | Curtis et al. |
| 4,466,366 | A | 8/1984 | Hirotsu |
| 4,469,037 | A | 9/1984 | Bost, Jr. |
| 4,483,260 | A | 11/1984 | Gallant |
| 4,501,212 | A | 2/1985 | Slattery |
| 4,519,332 | A | 5/1985 | Fukuda |
| 4,522,132 | A | 6/1985 | Slattery |
| 4,528,921 | A | 7/1985 | Slattery |
| 4,531,465 | A | 7/1985 | Hampton |
| 4,548,140 | A | 10/1985 | Price et al. |
| 4,549,496 | A | 10/1985 | Kile |
| 4,557,208 | A | 12/1985 | Ingram et al. |
| 4,574,716 | A | 3/1986 | Czelusniak, Jr. |
| 4,586,445 | A | 5/1986 | Card et al. |
| 4,597,344 | A | 7/1986 | Stutznacker |
| 4,608,935 | A | 9/1986 | Bardsley |
| 4,619,212 | A | 10/1986 | Card et al. |
| 4,630,558 | A | 12/1986 | Card et al. |
| 4,637,329 | A | 1/1987 | Czelusniak, Jr. |
| 4,653,293 | A | 3/1987 | Porat |
| 4,653,413 | A | 3/1987 | Bagnall |
| 4,665,845 | A | 5/1987 | Card et al. |
| 4,667,611 | A | 5/1987 | Yamamoto et al. |

(56) References Cited

U.S. PATENT DOCUMENTS

| | | | |
|---|---|---|---|
| 4,669,171 | A | 6/1987 | Card et al. |
| 4,682,554 | A | 7/1987 | Goto et al. |
| 4,686,918 | A | 8/1987 | Hjalmer et al. |
| 4,688,497 | A | 8/1987 | Card et al. |
| 4,693,190 | A | 9/1987 | Slattery |
| D293,323 | S | 12/1987 | Slattery et al. |
| 4,726,306 | A | 2/1988 | Crumbliss |
| 4,741,000 | A | 4/1988 | Fukuda |
| 4,786,177 | A | 11/1988 | Beckstein et al. |
| 4,790,252 | A | 12/1988 | Bardsley |
| 4,794,874 | A | 1/1989 | Slattery |
| 4,815,401 | A | 3/1989 | Bagnall |
| 4,815,402 | A | 3/1989 | Price |
| 4,815,403 | A | 3/1989 | Card et al. |
| 4,817,541 | A | 4/1989 | Magourik |
| 4,829,917 | A | 5/1989 | Morgante |
| 4,831,948 | A | 5/1989 | Itoh et al. |
| 4,836,118 | A | 6/1989 | Card et al. |
| 4,841,886 | A | 6/1989 | Watkins |
| 4,849,270 | A | 7/1989 | Evans et al. |
| 4,852,505 | A | 8/1989 | Dedmon |
| 4,856,441 | A | 8/1989 | Kurata |
| 4,860,674 | A | 8/1989 | Slattery |
| 4,864,946 | A | 9/1989 | Watkins |
| 4,867,080 | A | 9/1989 | Taylor et al. |
| 4,870,915 | A | 10/1989 | Bagnall |
| 4,890,924 | A | 1/1990 | Beckstein |
| 4,903,624 | A | 2/1990 | Card et al. |
| 4,903,625 | A | 2/1990 | Card et al. |
| 4,981,091 | A | 1/1991 | Taylor et al. |
| 4,991,523 | A | 2/1991 | Ingram |
| 5,005,498 | A | 4/1991 | Taylor et al. |
| 5,035,030 | A | 7/1991 | Pellari |
| 5,058,518 | A | 10/1991 | Card et al. |
| 5,080,028 | A | 1/1992 | Ingram |
| 5,094,178 | A | 3/1992 | Watkins |
| 5,143,003 | A | 9/1992 | Dedmon |
| 5,158,027 | A | 10/1992 | Ingram |
| 5,165,352 | A | 11/1992 | Ingram |
| 5,182,997 | A | 2/1993 | Bardsley |
| 5,189,966 | A | 3/1993 | Satterfield |
| 5,205,233 | A | 4/1993 | Ingram |
| 5,224,434 | A | 7/1993 | Card et al. |
| 5,267,520 | A | 12/1993 | Ingram |
| 5,295,450 | A | 3/1994 | Neely |
| 5,383,415 | A | 1/1995 | Padgett, III |
| 5,392,723 | A | 2/1995 | Kaju |
| 5,400,727 | A | 3/1995 | Neely |
| 5,413,832 | A | 5/1995 | Willey |
| 5,416,593 | A | 5/1995 | Cercruysse |
| 5,458,075 | A | 10/1995 | Tice et al. |
| 5,461,996 | A | 10/1995 | Kaju |
| 5,480,085 | A | 1/1996 | Smithe et al. |
| 5,484,639 | A | 1/1996 | Woodall et al. |
| 5,491,372 | A | 2/1996 | Erhart |
| 5,495,815 | A | 3/1996 | Bagnall |
| 5,499,588 | A | 3/1996 | Card et al. |
| 5,501,250 | A | 3/1996 | Edwards et al. |
| 5,503,096 | A | 4/1996 | Willey |
| 5,509,364 | A | 4/1996 | Bardsley |
| 5,513,586 | A | 5/1996 | Neely et al. |
| 5,526,760 | A | 6/1996 | Ok |
| 5,529,002 | A | 6/1996 | Piller |
| 5,544,605 | A | 8/1996 | Frost |
| 5,549,064 | A | 8/1996 | Padgett, III |
| 5,557,154 | A | 9/1996 | Erhart |
| 5,562,056 | A | 10/1996 | Christman, Jr. |
| 5,566,629 | A | 10/1996 | Satterfield |
| 5,566,630 | A | 10/1996 | Burgess et al. |
| 5,575,228 | A | 11/1996 | Padgett, III et al. |
| 5,588,383 | A | 12/1996 | Davis et al. |
| 5,622,126 | A | 4/1997 | Card et al. |
| 5,653,184 | A | 8/1997 | Bardsley |
| 5,662,054 | A | 9/1997 | Bardsley |
| 5,706,744 | A | 1/1998 | Card et al. |
| 5,706,745 | A | 1/1998 | Neely et al. |
| 5,738,030 | A | 4/1998 | Ok |
| 5,743,200 | A | 4/1998 | Miller et al. |
| 5,743,201 | A | 4/1998 | Card et al. |
| 5,794,551 | A | 8/1998 | Morrison et al. |
| 5,806,446 | A | 9/1998 | Morrison et al. |
| 5,809,917 | A | 9/1998 | McGowan et al. |
| 5,896,821 | A | 4/1999 | Neely et al. |
| 5,899,152 | A | 5/1999 | Bardsley et al. |
| 5,954,003 | A | 9/1999 | Beyer et al. |
| 5,974,991 | A | 11/1999 | Bardsley |
| 5,979,344 | A | 11/1999 | Christman, Jr. |
| 5,983,815 | A | 11/1999 | Card |
| 5,989,368 | A | 11/1999 | Tillander et al. |
| 6,009,818 | A | 1/2000 | Card et al. |
| 6,155,187 | A | 12/2000 | Bennett et al. |
| 6,196,145 | B1 | 3/2001 | Burgess |
| 6,202,580 | B1 | 3/2001 | Samilo |
| 6,213,036 | B1 | 4/2001 | Slattery |
| 6,224,203 | B1 | 5/2001 | Wotton |
| 6,228,460 | B1 | 5/2001 | Hamilton et al. |
| 6,230,638 | B1 | 5/2001 | Ownbey et al. |
| 6,244,203 | B1 | 6/2001 | Morgante et al. |
| 6,263,811 | B1 | 7/2001 | Crossley |
| 6,273,011 | B1 | 8/2001 | Amos |
| 6,283,053 | B1 | 9/2001 | Morgante et al. |
| 6,293,211 | B1 | 9/2001 | Samilo |
| 6,401,639 | B1 | 6/2002 | Samilo |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,651,571 | B2 | 11/2003 | Bennett et al. |
| 6,729,254 | B2 | 5/2004 | Mamiya |
| 6,758,154 | B2 | 7/2004 | Johnston |
| 6,776,109 | B2 | 8/2004 | Segars et al. |
| 6,782,838 | B1 | 8/2004 | Segars et al. |
| 6,807,917 | B1 | 10/2004 | Christman et al. |
| 6,823,900 | B2 | 11/2004 | Wildeman et al. |
| 6,827,030 | B2 | 12/2004 | Hicks |
| 6,834,601 | B2 | 12/2004 | Card et al. |
| 6,834,602 | B1 | 12/2004 | Hall |
| 6,877,447 | B2 | 4/2005 | Frost et al. |
| 6,877,449 | B2 | 4/2005 | Morgante et al. |
| 6,895,877 | B1 | 5/2005 | Weiner |
| 6,902,789 | B2 | 6/2005 | Funasako |
| 6,945,184 | B2 | 9/2005 | Frost et al. |
| 6,971,326 | B1 | 12/2005 | Clarke et al. |
| 7,007,617 | B2 | 3/2006 | Johnston |
| 7,033,661 | B2 | 4/2006 | Whitten et al. |
| 7,083,841 | B2 | 8/2006 | Oakey et al. |
| 7,089,874 | B2 | 8/2006 | Morgante et al. |
| 7,096,806 | B2 | 8/2006 | Card et al. |
| 7,130,711 | B2 | 10/2006 | Dabrowa et al. |
| 7,216,598 | B1 | 5/2007 | Christman, Jr. |
| 7,222,576 | B2 | 5/2007 | Kilgore |
| 7,237,497 | B2 | 7/2007 | Johnston |
| 7,243,513 | B2 | 7/2007 | Kohlman |
| 7,264,854 | B2 | 9/2007 | Stroppiana |
| 7,296,524 | B2 | 11/2007 | Beverly |
| 7,333,877 | B2 | 2/2008 | Dabrowa et al. |
| 7,347,151 | B1 | 3/2008 | Johnston et al. |
| RE40,194 | E | 4/2008 | Slattery |
| 7,350,443 | B2 | 4/2008 | Oakey et al. |
| 7,356,453 | B2 | 4/2008 | Gould |
| 7,426,895 | B2 | 9/2008 | Smith et al. |
| 7,431,974 | B2 | 10/2008 | Lovelady et al. |
| 7,438,007 | B1 | 10/2008 | Hall |
| 7,490,566 | B2 | 2/2009 | Hall |
| 7,490,569 | B2 | 2/2009 | Whitten et al. |
| 7,634,326 | B2 | 12/2009 | Christman, Jr. et al. |
| 7,682,686 | B2 | 3/2010 | Curro et al. |
| 7,685,952 | B2 | 3/2010 | Frost et al. |
| 7,707,953 | B2 | 5/2010 | Hillenbrand et al. |
| 7,717,049 | B2 | 5/2010 | Hillenbrand et al. |
| 7,717,051 | B1 | 5/2010 | Hall et al. |
| 7,814,850 | B2 | 10/2010 | Bearden |

(56) References Cited

U.S. PATENT DOCUMENTS

| | | | |
|---|---|---|---|
| 8,082,861 | B2 | 12/2011 | Lovelady et al. |
| 8,127,698 | B1 | 3/2012 | Ingram |
| 8,141,505 | B2 | 3/2012 | Hall et al. |
| 8,240,263 | B1 | 8/2012 | Frost et al. |
| 8,359,989 | B2 | 1/2013 | Hall et al. |
| 8,776,703 | B2 | 7/2014 | Hall et al. |
| 2002/0037388 | A1 | 3/2002 | Morgante et al. |
| 2002/0067483 | A1 | 6/2002 | Lacavara |
| 2003/0164130 | A1 | 9/2003 | Morgante et al. |
| 2004/0025767 | A1 | 2/2004 | Card et al. |
| 2004/0187268 | A1 | 9/2004 | Johnston |
| 2004/0253409 | A1 | 12/2004 | Whitten et al. |
| 2005/0056197 | A1 | 3/2005 | Card et al. |
| 2005/0109253 | A1 | 5/2005 | Johnston |
| 2005/0188905 | A1 | 9/2005 | Dabrowa et al. |
| 2005/0204975 | A1 | 9/2005 | Card et al. |
| 2006/0272564 | A1 | 12/2006 | Card et al. |
| 2007/0272137 | A1 | 11/2007 | Christman et al. |
| 2008/0134949 | A1 | 6/2008 | Bearden |
| 2009/0205547 | A1 | 8/2009 | Hall |

FOREIGN PATENT DOCUMENTS

| | | | |
|---|---|---|---|
| GB | 853943 | | 1/1957 |
| GB | 859761 | | 8/1959 |
| GB | 920023 | | 3/1960 |
| GB | 853943 | | 11/1960 |
| GB | 859761 | | 1/1961 |
| GB | 920023 | | 3/1963 |
| GB | 1 039 857 | | 8/1966 |
| GB | 1039857 | | 8/1966 |
| GB | 2050447 | | 1/1980 |
| GB | 2 050 447 | | 7/1981 |
| GB | 2115025 | A | 9/1983 |
| GB | 2 246 371 | | 1/1992 |
| GB | 2446371 | A | 1/1992 |
| GB | 2319786 | A | 3/1998 |
| GB | 2392172 | | 2/2004 |
| GB | 2385604 | B | 3/2005 |
| JP | 03-294562 | | 12/1991 |
| JP | 683787 | | 2/1992 |
| JP | 08003859 | | 1/1996 |
| JP | 2005240199 | | 9/2005 |
| JP | 2006-524753 | | 2/2006 |
| WO | WO8400388 | | 2/1984 |
| WO | WO9428225 | | 5/1994 |
| WO | WO 96/12843 | | 2/1996 |
| WO | WO9612846 | | 5/1996 |
| WO | WO0159195 | | 8/2001 |
| WO | WO2004057084 | | 8/2004 |
| WO | WO2006/076558 | | 7/2006 |
| WO | WO2006076558 | | 7/2006 |

OTHER PUBLICATIONS

Communication re: Notice of Opposition (and Exhibits included therewith) filed Mar. 12, 2015 against EP2321454.

Office Action for related Japanese application No. 2013-211615, mailed Aug. 22, 2014, with English translation.

Partial European Search Report for EP 14 16 7507 dated Mar. 18, 2015.

Office Action for JP 2013-024279, dated Dec. 27, 2013, with English translation.

Office Action for JP 2011-516872, mailed Dec. 3, 2012, with English translation.

Defendant Tuftco Corp.'s Motion to Stay Case Pending Determination of Inter Partes Review Proceedings, filed Dec. 29, 2014, *Card-Monroe Corp.*, v. *Tuftco Corp.*, E.D. Tenn., Case No. 1:14-cv-292.

Defendant Tuftco Corp.'s Memorandum in Support of Motion to Stay Case Pending Determination of Inter Partes Review Proceedings, filed Dec. 29, 2014, *Card-Monroe Corp.*, v. *Tuftco Corp.*, E.D. Tenn., Case No. 1:14-cv-292.

Plaintiff's Motion to Dismiss Defendant's Amended Counterclaims and to Strike Portions of Defendant's Affirmative Defenses, filed Jan. 22, 2015, *Card-Monroe Corp.*, v. *Tuftco Corp.*, E.D. Tenn., Case No. 1:14-cv-292.

Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit A to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit B to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit C to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit D to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit E to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit F to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.

Exhibit A to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.

Exhibit B to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.

Exhibit C to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.

Exhibit D to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.

Exhibit E to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.

Order, Filed Jan. 23, 2015, *Card-Monroe Corp.*, v. *Tuftco Corp.*, E.D. Tenn., Case No. 1:14-cv-292.

Plaintiff's Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.

Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.

Exhibit A to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.

Exhibit B to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.

(56) References Cited

OTHER PUBLICATIONS

Exhibit C to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit D to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit E to Plaintiffs Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit F to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Defendant Tufco Corp.'s Reply in Support of Motion to Stay Case Pending Determination of Inter Partes Review Proceedings, Filed Jan. 29, 2015, *Card-Monroe Corp.*, v. *Tuftco Corp.*, E.D. Tenn., Case No. 1:14-cv-292.
Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit A to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit B to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit C to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D, Tenn., Case No. 1:14-cv-292.
Order, Filed Feb. 19, 2015, *Card-Monroe Corp.*, v. *Tuftco Corp.*, E.D. Tenn., Case No. 1:14-cv-292.
Plaintiff's Reply Memorandum of Law in Support of Motion to Dismiss Defendant's Amended Counterclaims and to Strike Portions of Defendant's Affirmative Defenses, Field Feb. 26, 2015, *Card-Monroe Corp.*, v. *Tuftco Corp.*, E.D. Tenn., Case No. 1:14-cv-292.
Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit A to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit B to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit C to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit D to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit E to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit F to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit G to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No, 1:14-cv-292.
Exhibit H to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit I to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Defendant Tuftco Corp.'s Answer and Counterclaim, filed Nov. 24, 2014, in matter of *Card-Monroe Corp,* Plaintiff. v. *Tuftco Corp.*, Defendant—Case No. 1:14-cv-292, before Judge Mattice, Magistrate Judge Carter.
Defendant Tuftco Corp.'s Answer and Amended Counterclaim, filed Jan. 8, 2015, in matter of *Card-Monroe Corp,* Plaintiff. v. *Tuftco Corp.*, Defendant—Case No. 1:14-cv-292, before Judge Mattice, Magistrate Judge Carter.
Plaintiffs Memorandum of Law in Support of Motion to Dismiss Defendant's Counterclaims and to Strike Defendant's Fourth Through Seventh and Ninth Affirmative Defenses, filed Dec. 15, 2014, in matter of *Card-Monroe Corp,* Plaintiff. v. *Tuftco Corp.*, Defendant—Case No. 1:14-cv-292, before Judge Mattice, Magistrate Judge Carter.
Defendant Tuftco's Response Brief to Plaintiff Card-Monroe's Motion to Dismiss and Motion to Strike, filed Jan. 15, 2015, in matter of *Card-Monroe Corp,* Plaintiff. v. *Tuftco Corp.*, Defendant—Case No. 1:14-cv-292, before Judge Mattice, Magistrate Judge Carter.
Petition for Inter Partes Review Under 35 USC §§ 311-319 and CFR § 42.100 et seq, filed in Patent Trial and Appeal Board in the matter of *Tuftco Corp.* v. *Card-Monroe Corp.* on Dec. 24, 2014, Inter Partes Review No. IPR2015-00505.
Declaration of Ian Slattery filed in connection with Inter Partes Review No. IPR2015-00505.
Cobble Tufting Machine Company, Inc. ColorTec Operating and Maintenance Manual Servotec Software Version 3.10.xx Apr. 2005.
Spare parts Manual ColorTec, dated May 8, 1998.
Windows PCCI Operator's Manual, Version 1.0, dated Mar. 13, 1998.
Partial search report for related application, European Search Report, application No. EP 09 15 2848.
English translation of Japanese Office Action mailed Mar. 4, 2013, for related application, No. JP2009-032036.
Cobble, Blackburn Ltd., Servo Systems Operation Manual—New Software Version—Apr. 1999, Issue 2.11A—pp. 1-16.
Cobble, ST (with Graphical User Interface) Tufting Machine—Operator's Handbook—Revision 1.5, Software build 43—Issue Date: Sep. 2003.
Search report for related application, PCT International Search Report, application No. PCT/US2008/080946, filed Oct. 23, 2008.
Related application, No. WO 96/12843, publication date Feb. 5, 1996.
Related application, No. WO 2004/057084, publication date Aug. 7, 2004.
CAN with Encore DMC, Operator's Manual, Version 3.6, Tuftco Corporation, Copyright 1995, Chattanooga, TN.
Command Performance 200 Instruction Manual, Version 3.12, CMC #801107-01, Card-Monroe Corp., Copyright 1985-1994, Chattanooga, TN.
Tuft Program, Version 1.20, Nov. 1993, NedGraphics BV.
CMC Yarntronics Brochure, http://www.cardmonroe.com/Products/Yarntronics/yarnt.htm, printed Feb. 21, 2002.
Automation Comes to Paris, Carpet & Rug, Inc., 1987.
Moving Toward Total Automation, Carpet & Rug Industry, Dec. 1990.
International Search Report and Written Opinion for Application No. PCT/US2008/081527, mailed Feb. 18, 2009.
Search report for related application, International Search Report, application No. PCT/US2009/049501, filed Feb. 7, 2009.
Extended European Search Report dated Aug. 7, 2009, European Patent Application No. 09 152 848 .9 (Pub No. 2 100 994).
European Official Communication dated Mar. 25, 2010, European Patent Application No. 09 152 848 .9 (Pub No. 2 100 994).
European Notice of Intention to Grant a European Patent dated Dec. 13, 2010, European Patent Application No. 09 152 848 .9 (Pub No. 2 100 994).
Response submitted Sep. 30, 2010, to the Communication dated Mar. 25, 2010, European Patent Application No. 09 152 848 9 (Pub No. 2 100 994).
Carpet Design, Technology Are on a Roll, Kathryn Sellers, Carpet & Rug Institute, © 2001, Textile World, vol. 151, No. 3.

(56) References Cited

OTHER PUBLICATIONS

NedGraphics, Aug. 26, 1994, Carpet & Floor Coverings Review.
Simple or sophisticated: Computers: CAD, Sep. 11, 1992, Carpet & FloorCoverings Review, pp. 32-34.
Defendant Tuftco Corp.'s Amended Invalidity and Non-Infringement Contentions filed Dec. 9, 2015, *Card-Monroe Corp.* v. *Tufco Corp.*, E.D. Tenn., Case No. 1:14-cv-292.
Defendant's Opening Claim Construction Brief.
Plaintiff's Opening Claim Construction Brief.
Exhibit J—Lexmark Glossary—CMC Claim Construction Brief.
Exhibit L—Declaration of Steven Berger—CMC Claim Construction Brief.
Plaintiff's Responsive Claim Construction Brief.
Defendant's Responsive Claim Construction Brief.
EPO—Response to Opposition—EP Patent 2 321 454.
Third Office Action—Chinese text—CN 201210371253.0.
English translation of the Chinese Office Action—CN 201210371253.0.
Extended European Search Report for related European application No. 14167506.4-1710/2775023, dated Nov. 9, 2015.

THREE COLORS

FOUR COLORS

FIVE COLORS

SIX COLORS

YARN COLOR PLACEMENT SYSTEM

CROSS-REFERENCE TO RELATED APPLICATIONS

This application is a continuation application of prior U.S. Continuation Utility application Ser. No. 13/422,238, filed Mar. 16, 2012, entitled "Yarn Color Placement System, which application is a continuation application of prior U.S. Utility application Ser. No. 12/122,004, filed May 16, 2008, entitled "Yarn Color Placement System," now issued as U.S. Pat. No. 8,141,505, which application/patent claims the benefit of U.S. Provisional Application No. 61/029,105, filed Feb. 15, 2008, according to the statutes and rules governing provisional patent applications, particularly USC §119(e)(1) and 37 CFR §1.78(a)(4) and (a)(5). The entire disclosures of U.S. Utility application Ser. No. 13/422,238, U.S. Utility application Ser. No. 12/122,004 and U.S. Provisional Application No. 61/029,105 are incorporated herein by reference as if set forth in their entireties.

FIELD OF THE INVENTION

The present invention generally relates to tufting machines, and in particular, to a system for controlling the feeding and placement of yarns of different colors within a backing material passing through a tufting machine to enable formation of free-flowing patterns within a tufted article.

BACKGROUND OF THE INVENTION

In the tufting of carpets and other, similar articles, there is considerable emphasis placed upon development of new, more eye-catching patterns in order to try to keep up with changing consumer tastes and increased competition in the marketplace. In particular, there has been emphasis over the years on the formation of carpets that replicate the look and feel of fabrics formed on a loom. With the introduction of computer controls for tufting machines such as disclosed in the U.S. Pat. No. 4,867,080, greater precision and variety in designing and producing tufted pattern carpets, as well as enhanced production speeds, have been possible. In addition, computerized design centers have been developed to help designers design and create wider varieties of patterns, with requirements such as yarn feeds, pile heights, etc., being automatically calculated and generated by the design center computer.

Additionally, attempts have been made to develop tufting machines in which a variety of different color yarns can be inserted into a backing material to try to create more free-flowing patterns. For example, specialty machines have been developed that include a moving head that carries a single hollow needle in which the ends of the different color yarns are individually fed to the needle for insertion into the backing material at a selected location. Other machines having multiple needles in a more conventional tufting machine configuration and which move the backing material forwardly and rearwardly to place multiple colors in the backing material also have been developed. A problem exists, however, with such specialty tufting machines for individually placing yarns, in that the production rates of such machines generally are restricted as the yarns are placed individually in the backing material by the single needle or as the backing feed direction is changed. As a consequence, such specialized color patterning machines typically are limited to special applications such as formation of patterned rugs or carpets of limited or reduced sizes.

Accordingly, it can be seen that a need exists for a system and method that addresses these and other related and unrelated problems in the art.

SUMMARY OF THE INVENTION

Briefly described, the present invention generally relates to a yarn color placement system for a tufting machine for use in forming patterned tufted articles, such as carpets, including the formation of substantially free-flowing patterns and/or carpets with a woven or loom formed appearance. The tufting machine with the yarn color placement system of the present invention typically will include a tufting machine control system for controlling the operative elements of this tufting machine, and one or more shifting needle bars having a series of needles spaced therealong. A tufting zone is defined along the reciprocating path of the needles through which a backing material is fed at a programmed or prescribed rate of feeding or desired stitch rate. As the backing material is fed through the tufting zone, the needles are reciprocated into and out of the backing material to form loops of yarns therein.

A shift mechanism is provided for shifting the needle bar(s) transversely across the tufting zone, and multiple shift mechanisms typically will be utilized where the tufting machine includes more than one shifting needle bar. The shift mechanism(s) can include one or more cams, servo motor controlled shifters, or other shifters such as a "SmartStep" shift mechanism as manufactured by Card-Monroe Corp., which shift the needle bar in accordance with the designed pattern shift steps. The shift steps for the needle bar(s) will be accomplished in accordance with a cam or shift profile calculated or designed into the pattern when the pattern is created, or in accordance with pre-designed or pre-loaded patterns in the tufting machine controller. The cam or shift profile further can be varied depending on the number of colors to be used in the pattern being formed. For example, for three or four colors, a three or four color cam or cam profile can be utilized for shifting each needle bar.

The yarn color placement system further generally will include a pattern yarn feed mechanism or attachment for controlling the feeding of the yarns to their respective needles. The pattern yarn feed pattern mechanism can include various roll, scroll, servo-scroll, single end, or double end yarn feed attachments, such as, for example, a Yarntronics™ or Infinity™ or Infinity IIE™ yarn feed attachment as manufactured by Card-Monroe Corp. Other types of yarn feed control mechanisms also can be used to control the feeding of the yarns to their selected needles according to the programmed pattern instructions so as to pull low or backrob from the backing material those yarns to be hidden in the pattern fields being sewn at that time. The system control of the tufting machine further typically will control the operative functions of the tufting machine, including the operation of the shift mechanism(s) and yarn feed mechanism(s) according to the programmed pattern instructions.

Additionally, a looper or hook assembly including gauge parts such as cut-pile hooks, loop pile loopers, and/or level cut loopers or hooks generally will be provided below the tufting zone in a position so as to engage the needles as the needles penetrate the backing material so as to pick and/or pull loops of yarns therefrom. In one embodiment, a series of the level cut loop loopers are individually controlled by the system control of the tufting machine during each stitch, based on the pattern stitch being formed and shift profile step therefore, so as to be actuated or fired selectively for each stitch according to whether the loops of yarn being formed thereby are to be pulled back or backrobbed, and thus hidden upon the formation of each stitch in the pattern, kept as loop pile tufts, or retained on the level cut loop looper to form a cut pile tuft.

The yarn color placement system according to the principles of the present invention further generally will be operated at increased or denser stitch rates than conventional tufting processes. Typically, the operative or effective stitch rate run by the yarn placement system will be approximately equivalent to a desired or prescribed number of stitches per inch at which the backing material is fed, multiplied by the number of colors being run in the programmed pattern. As a consequence, as the needle bar(s) is shifted during the formation of the pattern stitches, for each color to be taken out or back-robbed and thus hidden in the finished patterned article, the increased number of stitches per inch will provide sufficient enhanced density to the finished patterned tufted article to avoid a missing color or gap being shown or otherwise appearing in the patterned article.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
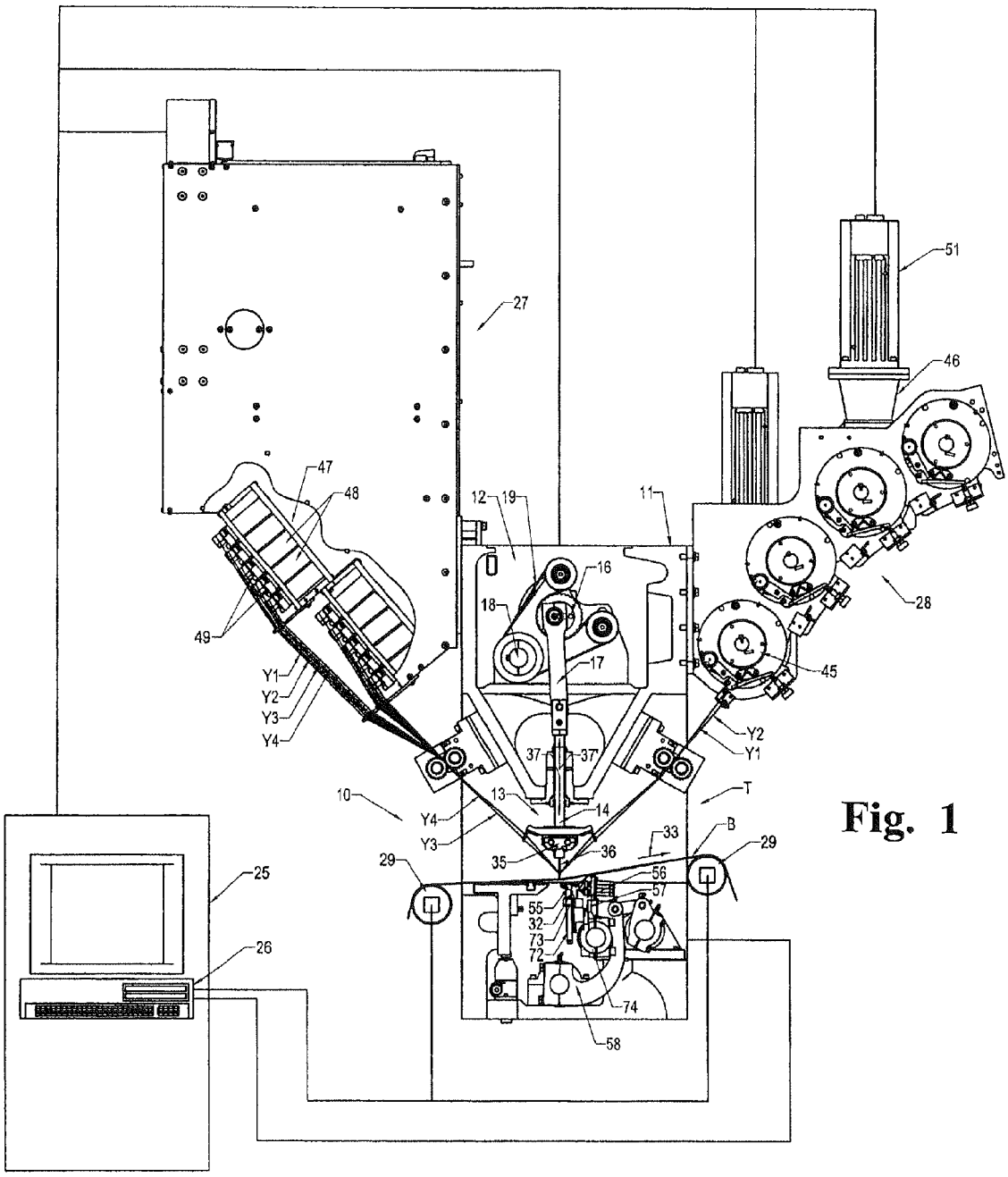
FIG. 1 is a side elevational view of a tufting machine incorporating the yarn color placement system of the present invention.

Referring now to the drawings in which like numerals indicate like parts throughout the several views, in accordance with one example embodiment of the yarn color placement system of the present invention, as generally illustrated in FIGS. 1-5, a tufting machine 10 is provided for controlling placement of yarns Y1-Y4, etc., of different colors at desired locations in a backing material B to form a tufted article having a variety of varying or free-flowing colored pattern effects therein. While four yarns/colors are indicated, it will be understood that more or fewer different color yarns (i.e., two color, three color, five color, six colors, etc., as illustrated in FIGS. 6A-6D) also can be utilized in the yarn color placement system of the present invention.

As generally illustrated in FIG. 1, the tufting machine 10 generally includes a frame 11, including a head portion 12 housing a needle bar drive mechanism 13 and defining a tufting zone T. The needle bar drive mechanism 13 (FIGS. 1, 3 and 4) typically includes a series of push rods 14 connected to a gear box drive 16 or similar mechanism, by connector rods 17. The gear box drive 16 in turn is connected to and driven off a main drive shaft 18 (FIGS. 1 and 4) for the tufting machine by one or more drive belts or drive chains 19, with the main drive shaft 18 itself being driven by a motor, such as a servo motor. Alternatively, the push rods 14 of the needle bar drive mechanism 13 can be directly connected via connector rods 17 to the main drive shaft 18 so as to be driven directly off the main drive shaft to control operation of the main drive shaft motor (not shown).

An encoder additionally can be provided for monitoring the rotation of the main drive shaft and reporting the position of the main drive shaft to a tufting machine control system 25 (FIG. 1). The tufting machine control system 25 generally will comprise a tufting machine control such as a "Command-Performance™" tufting machine control system as manufactured by Card-Monroe Corp. The control system also typically includes a computer/processor or controller 26 that can be programmed with various pattern information and which monitors and controls the operative elements of the tufting machine 10, such as the needle bar drive mechanism 13, yarn feed attachments 27/28, backing feed rolls 29, the main drive shaft 18, a needle bar shift mechanism 31 (FIGS. 3 and 4) and a looper or hook assembly 32 mounted beneath the tufting zone T of the tufting machine, as discussed more fully below. The tufting machine control system 25 (FIG. 1) further can receive and execute or store pattern information directly from a design center (not shown) that can be separate and apart from the tufting machine control system, or which can be included as part of the tufting machine control system. In response to such programmed pattern instructions, the tufting machine control system 25 will control the operative elements of the tufting machine 10 in order to form the desired tufted patterns in the backing material B as the backing material is passed through the tufting zone T in the direction of arrow 33 by the backing feed rolls 29.

As indicated in FIGS. 1-5, the needle bar drive mechanism 13 of the tufting machine 10 also will include one or more shiftable needle bars 35 attached to and driven by the push rods 14 and carrying a series of needles 36 arranged in in-line or offset rows spaced transversely along the length of the needle bar and across the tufting zone of the tufting machine. While only a single shifting needle bar 35, with an inline row of needles 36 arranged therealong is shown in the figures, it will be understood by those skilled in the art that additional arrangements of dual shifting needle bars having spaced rows of needles 36 arranged in-line or in a staggered or offset configuration also can be utilized in the tufting machine 10 incorporating the yarn control placement system according to the present invention.

During operation of the needle bar drive mechanism, the needles are reciprocated, as indicated by arrows 37 and 37' (FIG. 2), into and out of the backing material B, carrying the yarns Y1-Y4 so as to insert or place loops of yarn in the backing material for forming loop pile and cut pile tufts 38 in the backing material. Additionally, as illustrated in the embodiments shown in FIGS. 3 and 4, shift mechanism 31 generally will be linked to the needle bar 35 for shifting the needle bar in the direction of arrows 41 and 41', transversely across the tufting zone according to programmed pattern instructions. The shift mechanism 31 can include a Smart Step™ type shifter as manufactured by Card-Monroe Corp., or alternatively can include various other types of shift mechanisms including servo motor or hydraulically controlled shifters, and/or pattern cam shifters as are conventionally used.

Figure 6A:
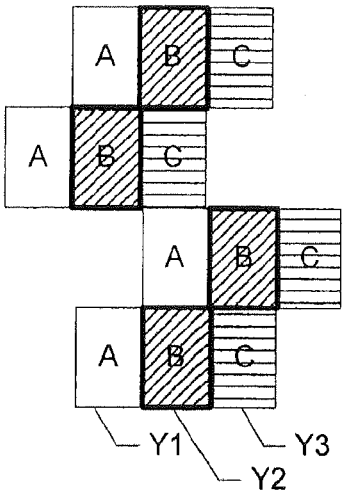
FIGS. 6A-6D are schematic illustrations of example shift/step patterns for tufting patterns having different numbers of colors using the method of the present invention.
Figure 6B:
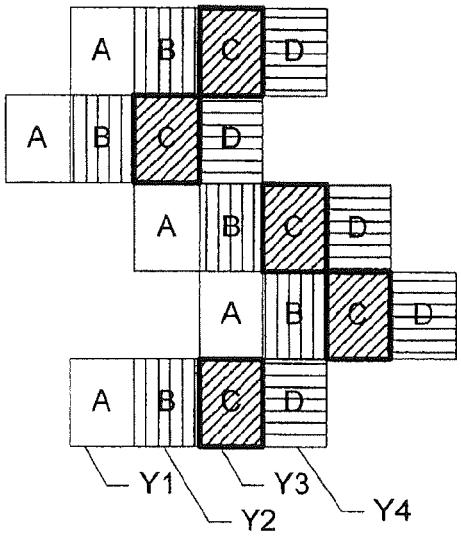
Figure 6C:
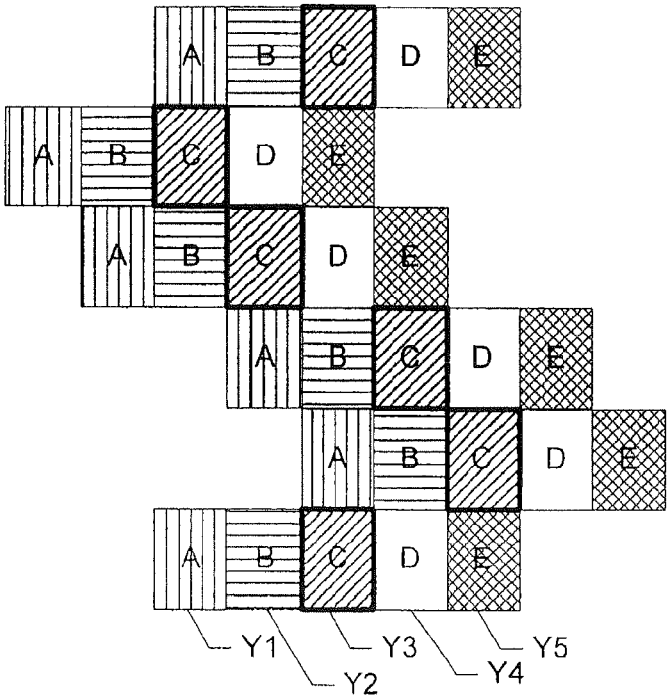
Figure 6D:
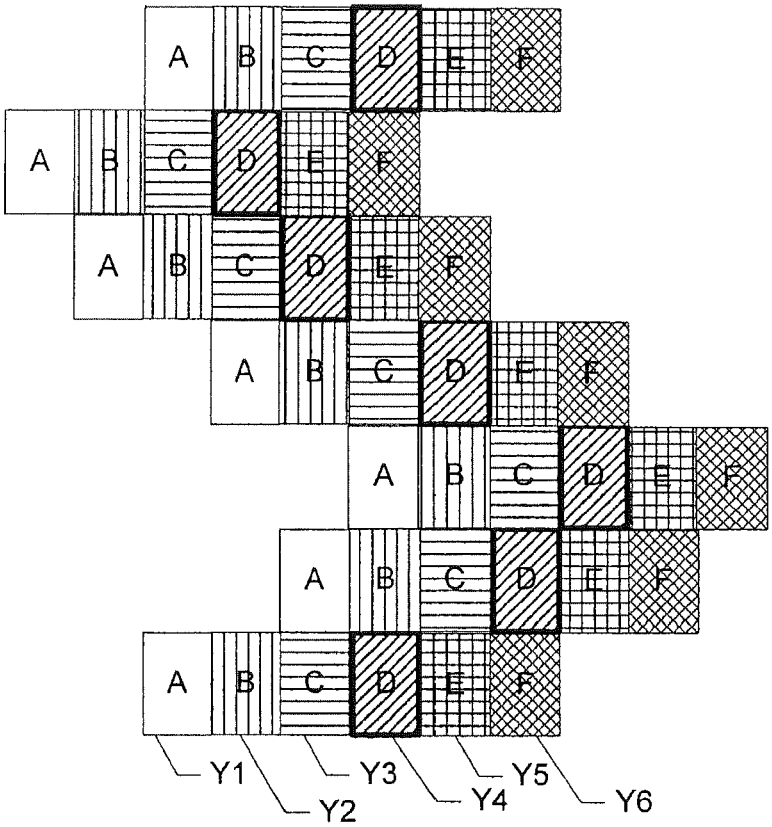

As part of the pattern information/instructions programmed into the tufting machine control system 25 (FIG. 1), there typically will be a cam profile or shift profile of the shift steps calculated for the pattern when it is created, such as at a design center, for controlling the shifting of the needle bar(s) as necessary to form the desired pattern. The pattern shift steps or cam profile further can be varied depending on the number of colors used in the pattern being run. FIGS. 6A-6D illustrate various shift or stepping patterns for the needle bar, reflecting the shifting of the needle bar where three, four, five or six different color yarns are utilized in the pattern, and illustrate single and double step or jump segments followed to avoid oversewing prior sewn tufts. For example, for running a stepping pattern utilizing three different colors of yarns, as indicated in FIG. 6A, an initial step or shift can be made to the right, which would then be followed by a double gauge shift or jump, ending with a single gauge shift. Similarly, for four, five and/or six colors, shown in FIGS. 6B-6D, after an initial shift to the right of a single or double gauge jump, the pattern then shifts back to the left using single and double gauge jumps or shifts in order to avoid sewing over or over-tufting previously sewn tufts. Additionally, while the initial shift or jump is shown as going to the right in FIGS. 6A-6B, it is also possible to start the shift steps to the left. Still further, as the needle bar is shifted, the backing material also is generally fed through the tufting machine at an increased or denser stitch rate to achieve a denser pattern or fill-in of the selected colors for the particular field of the pattern.

In some conventional tufting systems, the stitch rate for tufting patterns run thereby generally has been matched to the gauge of the tufting machine, i.e., for a tenth gauge tufting machine, the stitch rate typically will be approximately ten stitches per inch, while for an eighth gauge machine, the stitch rate will be approximately eight stitches per inch. In the present invention, the operative or effective stitch rate run by the yarn color placement system will be substantially higher, and thus more dense than typical desired stitch rates. Typically, with the yarn color placement system of the invention, this enhanced effective stitch rate will be approximately equivalent to the desired stitch rate multiplied by the number of different colors being run in the pattern. Thus, with yarn color placement system of the present invention, for a tenth gauge machine generally run using a desired stitch rate of approximately ten stitches per inch, if there are three colors in the pattern, the operative or effective stitch rate run by the yarn color placement system will be determined by the desired stitch rate (10 stitches per inch), multiplied by the number of colors (3), for an effective stitch rate of approximately thirty stitches per inch, for four colors, while the operative or effective stitch rate for a four color pattern can be approximately forty stitches per inch, fifty stitches per inch for five colors, etc.

Figure 3:
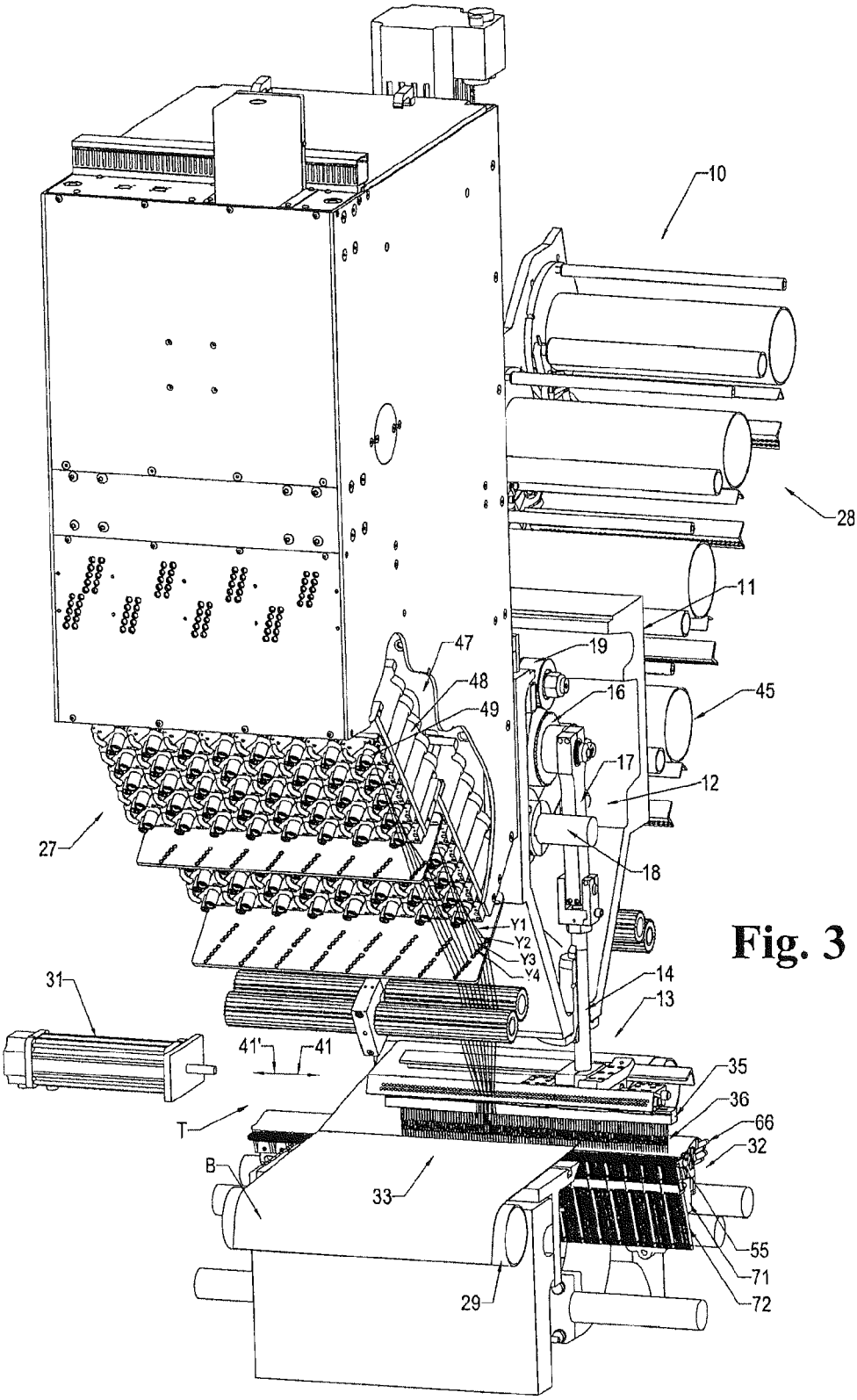
FIG. 3 is a perspective illustration of the yarn color placement system of FIG. 1.
Figure 4:
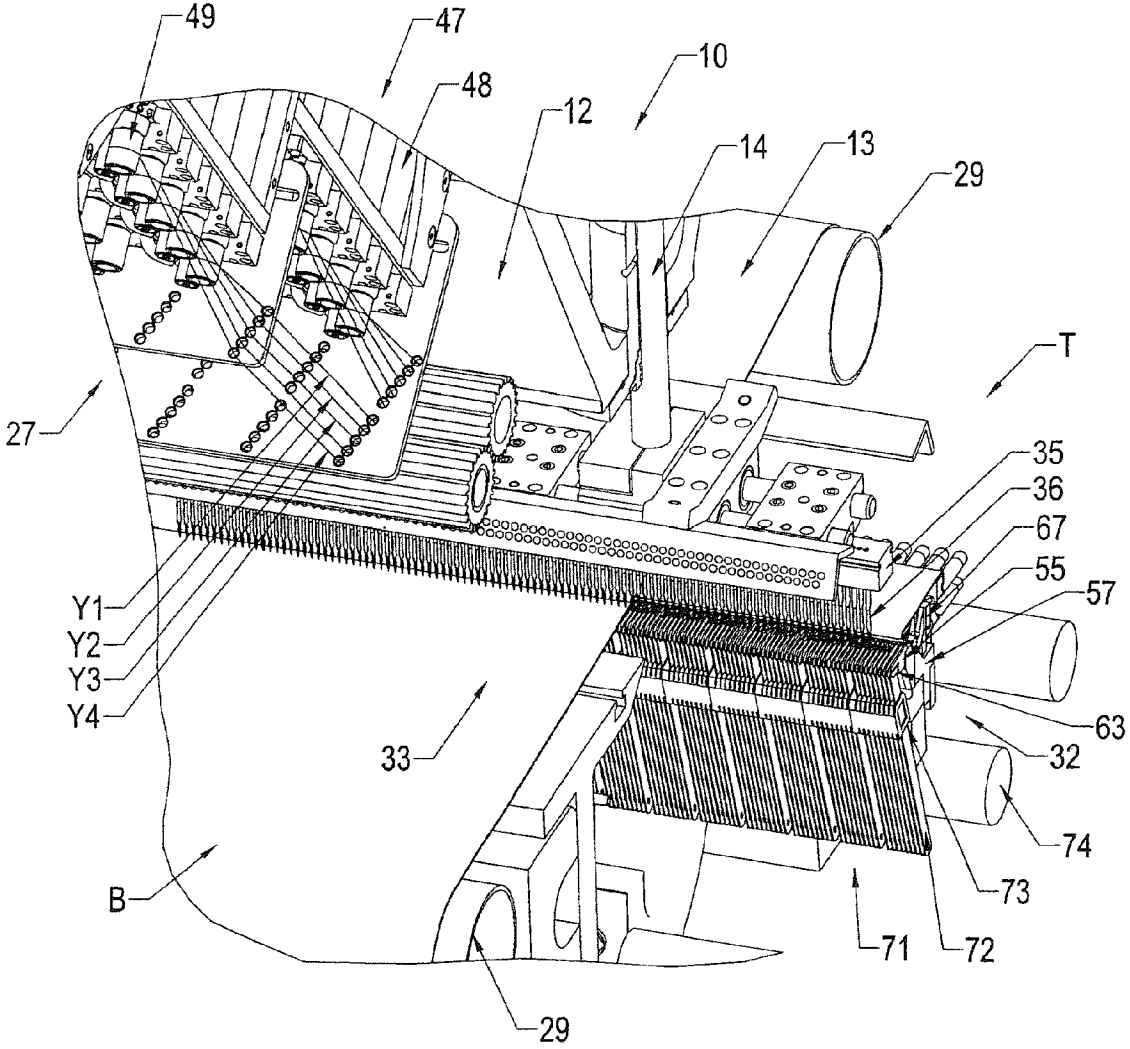
FIG. 4 is a perspective illustration, with parts broken away, illustrating the operation of the level cut loop loopers and shifting of the needle bars in the yarn color placement system of FIG. 1.

As additionally indicated in FIGS. 1, 3 and 4, one or more yarn feed attachments 27 and/or 28 also generally can be mounted to the frame 11 of the tufting machine 10 for controlling the feeding of the different color yarns Y1-Y4, etc., to each of the needles during operation of the tufting machine, including pulling back or back-robbing yarns that are to be hidden in particular color fields of the pattern. There are variety of yarn feed attachments that are utilized in the yarn color placement system of the present invention for controlling the feeding of the different color yarns Y1-Y4, etc. to various ones of the needles 36. For example, the pattern yarn feed attachments or mechanisms can include conventional yarn feed/drive mechanisms such as roll or scroll pattern attachments, as indicated at 28 in FIGS. 1 and 3, having a series of rolls 45 extending at least partially along the tufting machine and driven by motors 46 under direction of the system control 25 (FIG. 1), for controlling the feeding of all of the yarns across the tufting machine to form pattern repeats across the width of the backing material, and including Quick Thread™, Enhanced Graphics™, and/or Multi Pile Height Scroll yarn feed controls/attachments as manufactured by Card-Monroe Corp. Alternatively, other types of pattern yarn feed attachments can be used, as indicated at 27, which have multiple yarn feed drives 47 (FIG. 3), each including a motor 48 and feed rolls 49, for controlling the feeding of specific sets of repeats of yarns to selected needles, including the use of individual yarn feed rolls or drives 48 for controlling the feeding of single yarns or pairs of yarns to each of the needles 36, such as single end/servo-scroll attachments, and/or the Infinity™ and Infinity IIE™ systems as manufactured by Card-Monroe Corp.

For example, U.S. Pat. Nos. 6,009,818; 5,983,815; and 7,096,806 disclose pattern yarn feed mechanisms or attachments for controlling feeding or distribution of yarns to the needles of a tufting machine. U.S. Pat. No. 5,979,344 further discloses a precision drive system for driving various operative elements of the tufting machine. All of these systems can be utilized with the present invention and are incorporated herein by reference in their entireties. Additionally, while in FIG. 1 a roll or scroll-type pattern attachment is shown at 28 as being used in conjunction with a single or double end type yarn feed mechanism 27, it also will be understood by those skilled in the art all of the pattern yarn feed mechanisms 27/28 utilized to control the yarn feed in the yarn color placement system of the present invention can include only single or double end yarn feed controls, or only scroll, roll, or similar attachments, and can be mounted along one or both sides of the tufting machine.

As indicated in FIGS. 1-4, the backing material B is fed through the tufting zone along a feed or path in the direction of arrow 33 by the backing rolls 29 (FIGS. 1 and 2) by the operation of drive motors 51 that are linked to and controlled by the machine control system 25. The backing material B is fed at the effective stitch rate for the pattern being formed by the yarn color placement system of the present invention (i.e., the desired rate multiplied by the number of colors of the pattern), and is engaged by the needles 36 that insert the yarns Y1-Y4 (to form the tufts 38 in the backing material. As the needles penetrate the backing material, they are engaged by the looper/hook assembly 32 so as to form loops of yarns that then can be cut to form cut-pile tufts, or can be remain as loops according to each pattern step. The released loops of yarns can be back-robbed or pulled low or out of the backing by the operation of the pattern yarn feed attachment(s) 27/28 as needed to vary the height of the loops of the additional colored yarns that are not to be shown or visually present in the color field of the pattern being sewn at that step.

Figure 2:
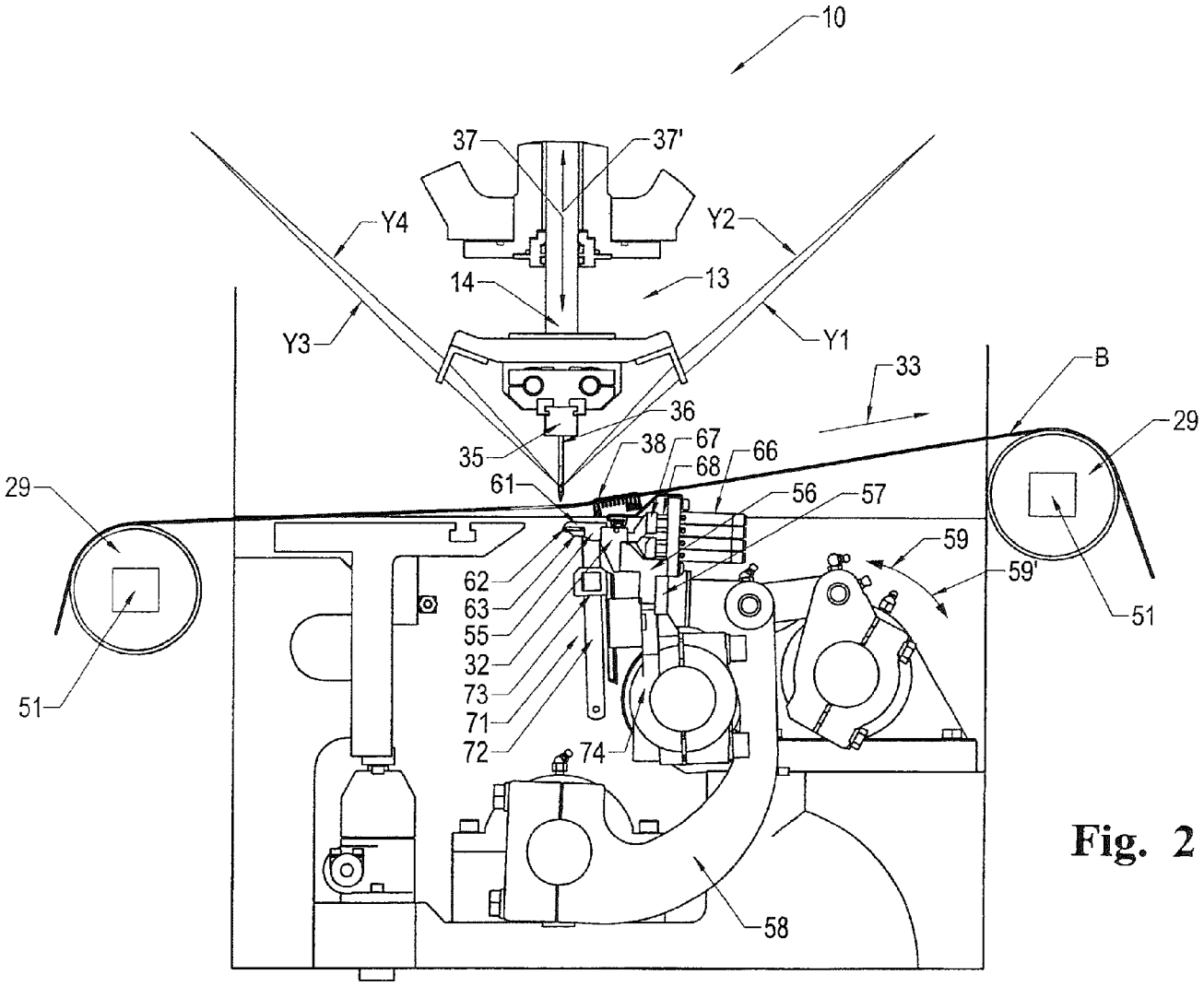
FIG. 2 is a side elevational view of the tufting machine of FIG. 1, illustrating the needles and level cut loopers.

As shown in FIGS. 1 and 2, the looper/hook assembly 32 generally is mounted below the bed and tufting zone T of the tufting machine 10. In one example embodiment of the yarn color placement system according to the present invention, the looper/hook assembly 32 generally includes a series of level cut loop loopers 55 (FIG. 2) mounted on a support block or holder 56 that is attached to a hook or looper bar 57 that is itself mounted on a reciprocating drive arm 58. The drive arm 58 reciprocates the level cut loop loopers 55 toward and away from the needles 36 in the direction of arrows 59 and 59', as the needles penetrate the backing material so that the level cut loop loopers engage the needles to pick and pull the loops of yarns therefrom. It also will be understood by those skilled in the art, however, that while the present invention as disclosed herein is for use with level cut loopers or hooks, it also could be possible to utilize loop pile loopers and/or cut pile hooks, as well as combinations of level cut loop loopers, cut pile hooks and/or loop pile loopers in the yarn placement system of the present invention in order to form the desired patterned articles.

As indicated in FIG. 2, each of the level cut loop loopers 55 generally includes a looper body 61, the rear portion of which is received in the support or hook block 56, and a hooked front or bill portion 62 that extends forwardly therefrom. A series of slots (not shown) generally are formed within the support block 56 adjacent each looper body 61, through which clips 63 are slidably received so as to be moveable from a retracted position rearward of the front portion 62 of each looper 55, to an extended position, projecting adjacent or in contact with the front bill portion 62, as indicated in FIG. 2. In its extended position, each clip prevents a loop of yarn engaged by its associated level cut looper 55 from being captured and held behind the hooked front or bill portion 62 and thereafter being cut. Each of the clips generally includes an elongated body typically formed from metal, plastic, composite or other similar material having a first proximal end that is adapted to extend adjacent the front bill portion of each associated level cut looper, and a rear portion (not shown) that extends through the support block 56.

The clips further each are linked to an associated actuator 66 by a connector or gate 67 which itself is connected to one or more output or drive shafts 68 of its associated actuator(s) 66. The actuators 66 are mounted in spaced, vertically offset rows, along an actuator block and generally can include hydraulic or other similar type cylinders or can include servo motors, solenoids or other similar type mechanisms for driving the clips between their extended and retracted positions.

Each connector or gate 67 further includes an actuator connector portion configured to be connected to an output shaft of an actuator, an extension portion extending forwardly from and at an angle with respect to the actuator connector portion along a direction transverse to the axial direction and a slot portion connected to the extension portion and defining a connector slot extending from the extension portion. The connector slot is configured to engage an associated clip 63, with the connector slot further including laterally spaced side walls defining the slot in which the clip is received. Additionally, each connector slot can be about 0.001 inches-0.003 inches greater in width than the width of the clip that is received therein to enable seating of the clips therein while preventing twisting of the clips during movement thereof, as the lateral side walls generally will prevent substantial lateral movement of the clips relative to their connectors and thus will prevent rotation of the clips about the longitudinal axis of the clips.

Figure 5:
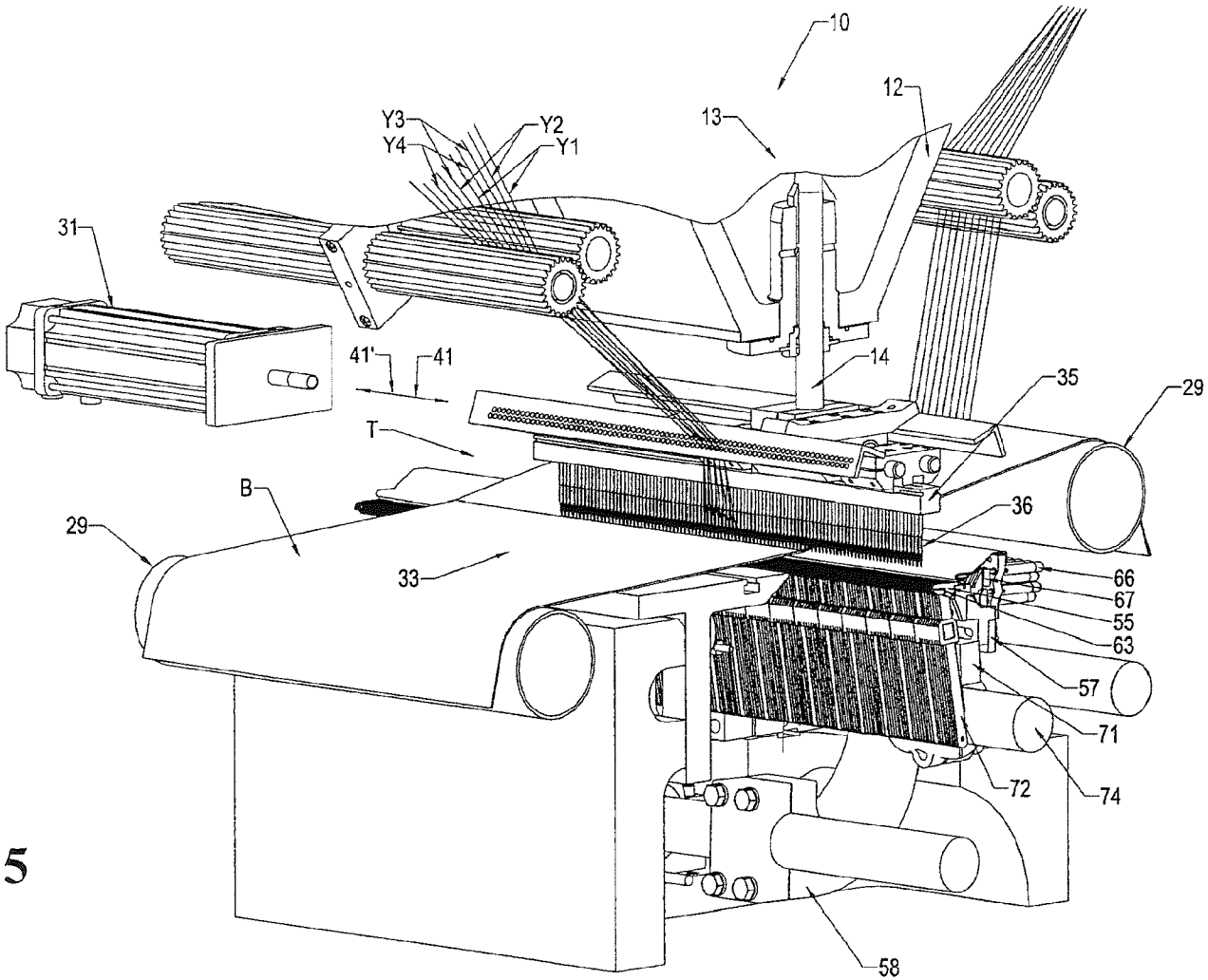
FIG. 5 is a perspective view illustrating a portion of the tufting zone of the tufting machine according to the embodiment of FIG. 1

As further illustrated in FIGS. 2 and 5, a series of knife assemblies 71 typically are provided adjacent the level cut loopers 55 of the hook or looper/hook assembly 32. The knife assembly 71 generally include a knife or cutting blade 72 mounted within the holder 73 connected to a reciprocating drive mechanism 74. The knives are reciprocated into engagement with the level cut loopers 55 so as to cut any loops of yarns selectively captured thereon in order to form the cut pile tufts 38 in the backing material as the backing material B is passed through the tufting zone in the direction of arrow 33, as indicated in FIG. 2.

Figure 7:
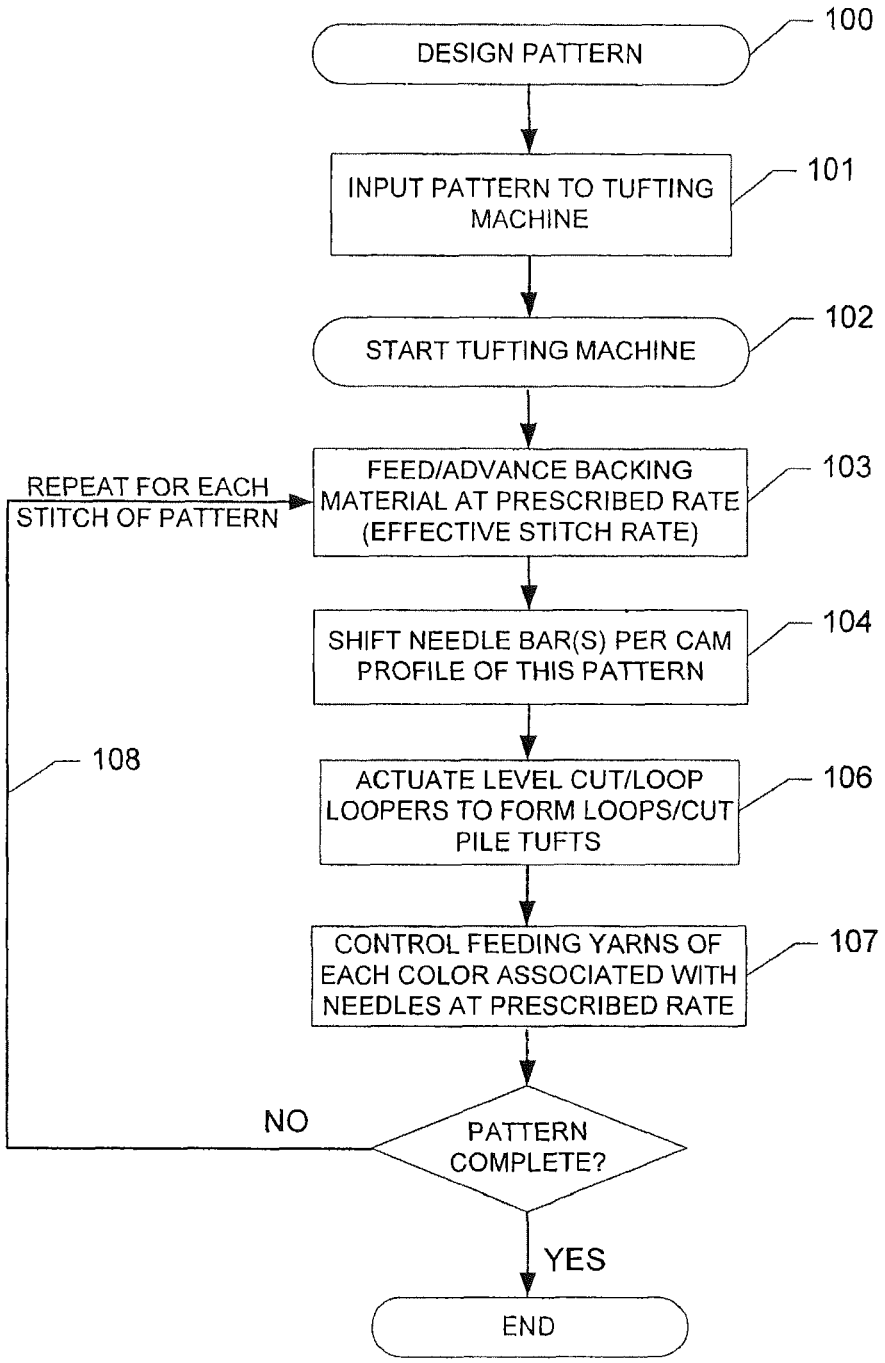
FIG. 7 is a flow diagram illustrating the operation of the yarn color placement system according to the present invention.

FIG. 7 generally illustrates one embodiment of the operation of the yarn color placement system according to the principles of the present invention. As an initial step 100, the pattern generally will be designed, such as at a design center, with various parameters, such as the number of colors, desired stitch rate, and shifts or jumps of the pattern generally inputted or calculated to create the desired pattern, including the use of a variety of different colored yarns. Thereafter, as indicated at step 101, the pattern will be transferred to the tufting machine 10 (FIG. 1) generally by being loaded into the system control 25 for the tufting machine by disk or network connection to the design center. Once the desired pattern(s) has been loaded, the tufting machine will be started, as indicated at 102 (FIG. 7), to start the tufting operation.

As the pattern is sewn, the backing material B (FIG. 2) is fed through the tufting zone T at the prescribed or effective stitch rate, as indicated in block 103 (FIG. 7). As discussed above, this effective stitch rate is substantially faster than conventional stitch rates (i.e., by a factor approximately equivalent to the number of colors being tufted) in order to provide sufficient density for the tufts being formed in the pattern fields to hide those color yarns not to be shown. As indicated at step 104, as the pattern is formed in the backing material, the needle bars are generally shifted per the cam profile or shift profile of the pattern. For example, as indicated in FIGS. 6A-6D, the needle bar will be shifted using a combination of single and/or double jumps or shifts, based on the number of colors being run in the pattern and the area of the pattern field being formed by each specific color. Such a combination of single and double shift jumps or steps will be utilized in order to avoid over-tufting or engaging previously sewn tufts as the needle bar is shifted transversely and the backing material advances at its effective or operative stitch rate. Additionally, as the needles penetrate the backing material, the level cut loop loopers 55 (FIG. 2) of the looper/hook assembly 32 positioned below the tufting zone T, also are reciprocated toward the tufting zone so as to engage and pick or pull loops of yarns from each of the needles.

As indicated in FIG. 7 at step 106, as the level cut loop loopers are being moved into engagement with the needles, they are selectively actuated, as needed to form loops of yarns that either will be released from the level cut loop loopers, or retained thereon for forming cut pile tufts. The level cut loop loopers each will be individually controlled by the control system 25 (FIG. 1) of the tufting machine so as to be selectively fired, as needed, according to the movement of the stepping or shifting needle bar. As a result, for each step or shift of the needle bar according to the pattern, each level cut looper actuator will be controlled individually so as to selectively engage or retract its clip to enable selected loops of yarns to be picked from the needles by the level cut loop loopers and held for cutting, thus forming cut pile tufts. In their extended positions, the clips will cause the loops of yarns engaged by the level cut loop loopers to be released to form either loop pile tufts, or which will be pulled low or back-robbed by operation of the pattern yarn feed attachment controlling the feeding of such yarns, to hide or bury the non-selected ends of these yarns within a particular color field being formed according to the pattern instructions.

As the needles are retracted from the backing material during their reciprocal movement in the direction of arrow 37' (FIG. 2), the feeding of the yarns by the pattern yarn feed attachments or yarn feed mechanisms 27/28 (FIG. 1) also will be controlled as indicated at step 107 (FIG. 7). The feeding of the yarns of the non-selected colors (i.e., the colors that are to be hidden and thus not visible in the particular color fields of the pattern being sewn at that step) will be controlled so that these yarns will be back-robbed or pulled low, or even pulled out of the backing material by the yarn feed mechanisms feeding each of these yarns. The effective stitch rate being run by the yarn color placement system of the present invention further provides for a denser field of stitches or tufts, so that the yarns being pulled low or backrobbed are effectively hidden by the remaining cut and/or loop pile tufts formed in the backing material.

The control of the yarn feed by the yarn feed pattern attachments for the control of the feeding of yarns of a variety of different colors, in conjunction with the operation of each shift mechanism and level cut loop loopers or hooks and/or cut pile hooks and loop pile hooks, and with the backing material being run at an effective or operative stitch rate that is substantially increased or denser than stitch rates solely based upon gauge of the machine enables the yarn color placement system of the present invention to provide for a greater variety of free-flowing patterns and/or patterns with a loom-formed appearance to be formed in the backing material. As indicated at step 108 in FIG. 7, the operation of the yarn color placement system continues, and is repeated for each stitch of the pattern until the pattern is complete.

It will be understood by those skilled in the art that while the present invention has been discussed above with reference to particular embodiments, various modifications, additions and changes can be made to the present invention without departing from the spirit and scope of the present invention.

What is claimed:

1. A tufting machine for forming tufted articles having a pattern with a desired stitch rate and including tufts of different color yarns, comprising:

at least one needle bar having a series of needles mounted therealong;

backing feed rolls for feeding a backing material through a tufting zone of the tufting machine;

a pattern yarn feed mechanism for feeding the yarns to said needles;

at least one needle bar shifter for shifting said at least one needle bar transversely across the tufting zone;

a series of gauge parts mounted below the tufting zone in a position to engage said needles of said at least one needle bar as said needles are reciprocated into the backing material to form loops of yarns in the backing material; and a control system for controlling said yarn feed mechanism in cooperation with said at least one needle bar shifter to control feeding of the yarns to said needles as needed to retain loops of selected yarns to form tufts of yarns of a desired pile height and to pull non-selected yarns substantially out of the backing material, said control system further controlling the feeding of the backing material at a stitch rate that is greater than the desired stitch rate for the pattern of the tufted article being formed so as to form color fields of the tufts of the selected yarns in the backing material with a number of tufts per inch of the selected yarns retained in the backing material sufficient to substantially hide the non-selected yarns and avoid a gap from appearing within the color fields.

2. The tufting machine of claim 1, wherein the yarns include at least 3 different color yarns.

3. The tufting machine of claim 1 and wherein said gauge parts comprise a plurality of level cut loop loopers, each having a series of extensible clips, a series of actuator connectors configured to connect an output shaft of an actuator to each of said clips for movement of said clips between extended and retracted positions for forming loop pile and cut pile tufts, and an extension portion extending forwardly from and at an angle with respect to said actuator connectors and configured to receive one of said clips of one of said level cut loop loopers.

4. The tufting machine for claim 1 and wherein said pattern yarn feed mechanism comprises a series of yarn feed rolls each feeding at least two yarns per feed roll to selected needles.

5. The tufting machine of claim 1 and wherein said pattern yarn feed mechanism comprises a scroll attachment, roll attachment, a double end yarn feed attachment, or a single end yarn feed attachment.

6. The tufting machine of claim 1 and wherein said gauge parts comprise cut pile hooks, loop pile loopers, level cut loop loopers and/or combinations thereof.

7. A method of tufting an article including tufts of multiple different color yarns arranged in accordance with a desired tufted pattern having a desired stitch rate, comprising:

feeding a backing material through a tufting machine;

reciprocating a series of needles to deliver the yarns into the backing material to form loops of yarns therein;

shifting at least some of the needles transversely according to a shift profile of pattern for the tufted article;

controlling feeding of the yarns to the needles in accordance with the shift profile of the pattern for the tufted article as the needles are shifted and are reciprocated into and out of the backing material to form the loops of yarns at varying pile heights, including pulling back or removing loops of yarns delivered into the backing material, for forming pattern fields of tufts of selected color yarns;

wherein the feeding of the backing material comprises feeding the backing material through the tufting machine at an increased stitch rate that is greater than the desired stitch rate, the increased stitch rate being at least twenty stitches per inch so as to form the pattern of the tufted article with a sufficient density of tufts per inch of yarns of one or more colors that are to be visible in a selected field of the pattern approximately equivalent to the desired stitch rate of the pattern to substantially hide yarns of colors not to be shown in the selected pattern field.

8. The method of claim 7 and wherein controlling feeding of the yarns comprises back-robbing the selected yarns to form low tufts having a pile height sufficient to be hidden among the high tufts formed in the selected field of the tufted pattern.

9. The method of claim 7 and wherein controlling feeding of the yarns comprises controlling each yarn fed to each needle to selectively form tufts of yarns to be visible in the pattern fields and to pull or remove yarns that are not to be visible in the pattern fields low or out of the backing material.

10. The method of claim 7 and wherein at least three different colors of yarns are used in the pattern and the increased stitch rate is at least about two times the desired stitch rate for the article and is based upon a gauge of the tufting machine.

11. The method of claim 10 and further comprising forming a number of different pile height tufts of yarns of the one or more colors to be visible in the selected field of the pattern in each tuft row that is substantially equivalent to the desired stitch rate for the pattern.

12. A method of operating a tufting machine to form a patterned tufted article having multiple colors and having a desired stitch rate, comprising:

feeding a backing material through the tufting machine;

feeding a plurality of yarns to a series of needles carried by a shiftable needle bar and reciprocating the needles into and out of the backing material;

as the needles are reciprocated into the backing material, forming a series of loops of yarns in the backing material;

shifting the needle bar transversely according to a programmed shift profile for the pattern of the tufted article; and controlling the feeding of the yarns to the needles in accordance with programmed pattern instructions to feed desired amounts of the yarns to the needles to form the loops of yarns at varying pile heights in the backing material, including pulling loops of non-selected color yarns low or out of the backing material, so as to define pattern fields of tufts of visible yarns of selected colors in the backing material;

wherein the backing material is fed at an increased stitch rate that is greater than the desired stitch rate and the feeding of the yarns to form the tufts of yarns tracks the shifting of the needles to form the loops at the increased stitch rate and the increased stitch rate is at least two times the desired stitch rate so that the tufts of visible yarns in the pattern fields defined in the backing material are formed at a density sufficient to substantially hide loops of the non-selected color yarns not to be shown and avoid a missing color or gap in the pattern fields.

13. The method of claim 12 and wherein controlling the feeding of the yarns comprises feeding a first amount of yarn to each needle forming a high loop of yarn, while feeding a second, lesser amount of yarn to each needle forming a low loop of yarn.

14. The method of claim 12 and further comprising forming a number of high loops in the backing that substantially matches the desired stitch rate.

15. The method of claim 12 and wherein the patterned tufted article includes two to six colors, and wherein the increased stitch rate at which the backing material is fed is at least about twenty stitches per inch.

16. The method of claim 12 and further comprising repeating an initial shift step in a shift profile of the pattern.

17. The method of claim 12 and further comprising selectively actuating a series of clips of level cut loop loopers for each stitch of the pattern to form cut pile and loop pile tufts.

18. A method of tufting a carpet pattern including tufts of a plurality of different color yarns formed approximately at a desired stitch rate for the pattern, comprising:

feeding a backing material along a path of travel;

reciprocating a series of needles into and out of the backing material;

shifting the needles transversely across the backing material;

as the needles are shifted and reciprocated, feeding the yarns to the needles so that for each stitch location of a plurality of stitch locations, a number of different color yarns are presented into the backing material sufficient to form tufts of different color yarns in the backing material at an increased stitch rate that is approximately equivalent to the desired stitch rate for the pattern multiplied by the number of different color yarns presented into the backing material at each said stitch location of the plurality of stitch locations;

controlling the feeding of the yarns to the needles in accordance with the pattern being formed so that as the needles are shifted and reciprocated, yarns not to be shown or visually present in a color field of the pattern being sewn are substantially removed or back-robbed from the backing material;

wherein the formation of the tufts of yarns at the increased stitch rate provides a sufficient density of tufts of remaining yarns to be shown in the color field to substantially avoid a missing color or gap appearing in the color field.

19. The method of claim 18, wherein shifting the needles comprises shifting at least one needle bar carrying a series of needles in accordance with a shift profile based on a number of colors of the pattern being formed.

20. The method of claim 18, wherein shifting the needles comprises shifting at least one needle bar carrying a least a portion of the needles multiple times based on a number of colors of the pattern.

21. The method of claim 20, wherein the pattern comprises at least two colors and the at least one needle bar is shifted at least three times for each pattern step.

22. A method of tufting a carpet pattern including tufts of different color yarns, with the tufts formed approximately at a desired stitch rate for the pattern, comprising:

reciprocating a series of needles carrying the yarns into a backing material;

for each step of the pattern, shifting at least some of the needles transversely across the backing material based upon a number of colors of the pattern; and controlling feeding of the yarns to the needles as the needles are reciprocated into and out of the backing material and as at least some of the needles are shifted transversely across the backing material in conjunction with controlling feeding of the backing material in a longitudinal direction so as to deliver a series of different color yarns into the backing material at an increased stitch rate that is greater than the desired stitch rate for the pattern by an amount sufficient to enable removal of at least some of the series of different color yarns from the backing material while retaining yarns of selected colors that are to be visible in the carpet pattern, with the retained yarns of the selected colors to be visible in the carpet pattern having a density of tufts per inch that is approximately equivalent to the desired stitch rate for the pattern.

23. The method of claim 22, further comprising:

reciprocating level cut loop loopers, each having a clip associated therewith, into engagement with the needles as the needles are reciprocated into the backing material so as to pick up loops of the yarns carried by the needles;

moving the clips of a selected series of the level cut loop loopers into positions enabling capture of the loops of the yarns along the selected series of level cut loop loopers;

cutting the captured loops of yarns along the selected series of level cut loop loopers to form cut pile tufts; and wherein controlling feeding of the yarns comprises controlling feeding of the yarns of the loops of yarns not captured by the selected level cut loop loopers to form loop pile tufts of selected colors while removing loops of yarns of non-selected colors.

* * * * *